US006053849A

United States Patent [19]

Wang

[11] Patent Number: 6,053,849

[45] Date of Patent: Apr. 25, 2000

[54] FRONT PULLEY OF A TREADMILL

[76] Inventor: Leao Wang, No. 1, Lane 154, Charng Long Rd., Taiping City, Taichung Hsien, Taiwan

[21] Appl. No.: 09/160,378

[22] Filed: Sep. 25, 1998

[51] Int. Cl.[7] ..... A63B 21/00

[52] U.S. Cl. ..... 482/54

[58] Field of Search ..... 482/54, 51

[56] References Cited

U.S. PATENT DOCUMENTS

| | | | |
|---|---|---|---|
| 4,635,928 | 1/1987 | Ogden et al. | 482/54 |
| 5,431,612 | 7/1995 | Holden | 482/54 |
| 5,447,479 | 9/1995 | Gvoich | 482/54 |
| 5,688,209 | 11/1997 | Trulaske et al. | 482/54 |

*Primary Examiner*—Glenn E. Richmon

[57] ABSTRACT

The invention relates to improvement for the front pulley of a treadmill, wherein a positioning plate is disposed at each of both sides of the front end of a frame of a treadmill. A hole is located at the middle of the positioning plate, and a resilient body having hollow metal ring at its inner is sideways disposed in each hole. Shafts at both sides of the front pulley in cooperation are disposed in the inner holes of the metal rings of the resilient bodies. When the rear pulley at both side of the frame is integrated, while the running belt is assembled on the front and rear pulleys and is tightened, the front pulley keeps on a parallel with the rear pulley automatically because of the tightening effect of the running bell by the action of the two resilient bodies. Thus, the running belt continuously circulates around the front and rear pulleys smoothly, and instant idling between the front pulley and the running belt do not occur and increases the operation safety.

3 Claims, 3 Drawing Sheets

FRONT PULLEY OF A TREADMILL

BACKGROUND OF THE INVENTION

1. Field of the Invention

The invention relates to the front pulley of a treadmill and, more particularly, to a new invention that keeps on a parallel with the rear pulley automatically and eliminates the instant idling phenomenon between the front pulley and the running belt.

2. Description of the Prior Art

As shown in FIG. 1, a treadmill 10 is caterpillar-type indoor exercising equipment which comprises mainly a frame 11 with a front and a rear pulleys 12 and 13 integrated at its front and rear ends. A running belt 20 encircles the front and rear pulleys 12 and 13. As a user runs on the running belt 20, the running belt 20 circulates around the front and rear pulleys 12 and 13 continuously without translocation. In order to make the running belt 20 continuously circulates around the front and rear pulleys 12 and 13 smoothly, the pulleys 12 and 13 must always be parallel to each other and the running belt 20 must be taut to avoid the instant idling phenomenon.

Referring to FIG. 2, an assembling diagram of a prior front pulley of a treadmill, positioning plates 21 having holes are disposed at both sides of each of the front and rear ends to locate the front and rear pulleys 12 and 13 in the holes of their corresponding positioning plate 21 by their own shafts 14. A flywheel 16 integrated on one side of the front pulley 12 connects to the shaft 19 of a motor 18 by a belt 17. Therefore, when the motor 18 operates, the front pulley 12 is rotated, thereby driving the running belt 20 to circulale around the front and rear pulleys 12 and 13 continuously.

A screw hole is disposed on the shaft 14 at one side of the front pulley 12 to keep the front pulley 12 and the rear pulleys 13 in parallel, and an adjusting screw 23 is screwed on the outside of the positioning plate 21 located there. Therefore, the position and angle of the front pulley 12 can be adjusted by the action of the adjusting screw 23.

However, since the front pulley 12 must be adjusted and corrected to be parallel to the rear pulley 13 during assembling it takes much time to assemble and repeated testing is required. In addition processing of the front pulley 12 is complex, thus increasing the fabricating cost.

Besides, locations of the front and rear pulleys 12 and 13 and tile running belt 20 are fixed after assembling and the running belt 20 is driven to circulate by the front pulley 12. When a downward force is applied to the running belt 20, the running belt 20 is forced and is instantly tightened. However, the front pulley 12 keeps on swiveling as being driven by the motor 18. The contact point between the running belt 20 and the rear pulley 13 becomes tighter while the contact point between the running belt 20 and the front pulley 12 gets looser, and an idling phenomenon may occur between the running belt 20 and the front pulley 12. To put it briefly, the running belt 20 may be stuck instantly. Although the stuck phenomenon takes only a very short time, the user may become off balance, just like the heel of a running is stamped during running, thus serious injury may take place.

SUMMARY OF THE INVENTION

Therefore, seeing the aforementioned conditions, the inventor devotes himself to research and develop according to his practical experience and skill to the field, trying to provide a new invention in which the front pulley adapts to the angle and position of the rear pulley and the front and rear pulleys keep parallel to each other, thus idling between the front pulley and the running bell will not occur, thereby increasing the operation safety the primary object of the invention.

BRIEF DESCRIPTION OF THE DRAWINGS

The technical and structure characteristics of the invention arc illustrate with reference to the appended drawings, wherein.

DETAILED DESCRIPTION OF THE INVENTION

Figure 1:
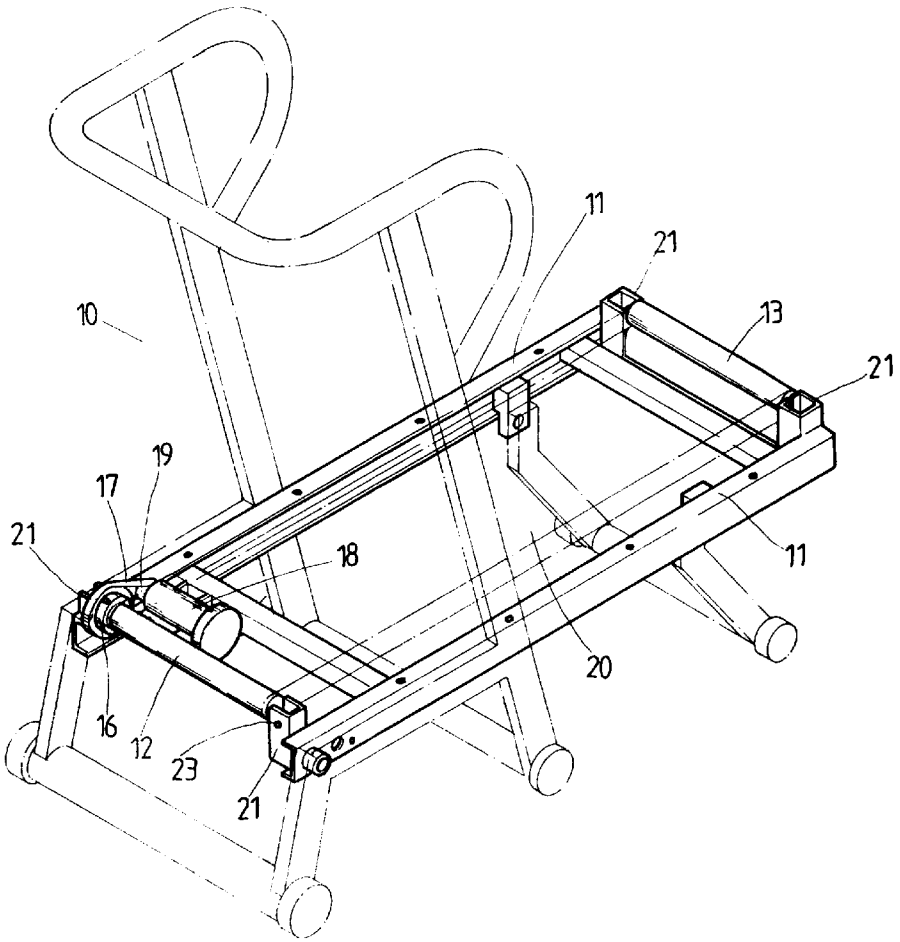
FIG.1 PRIOR ART
FIG. 1 is a perspective diagram showing the assembling positions of the front and rear pulleys and the running belt of a prior treadmill.
Figure 2:
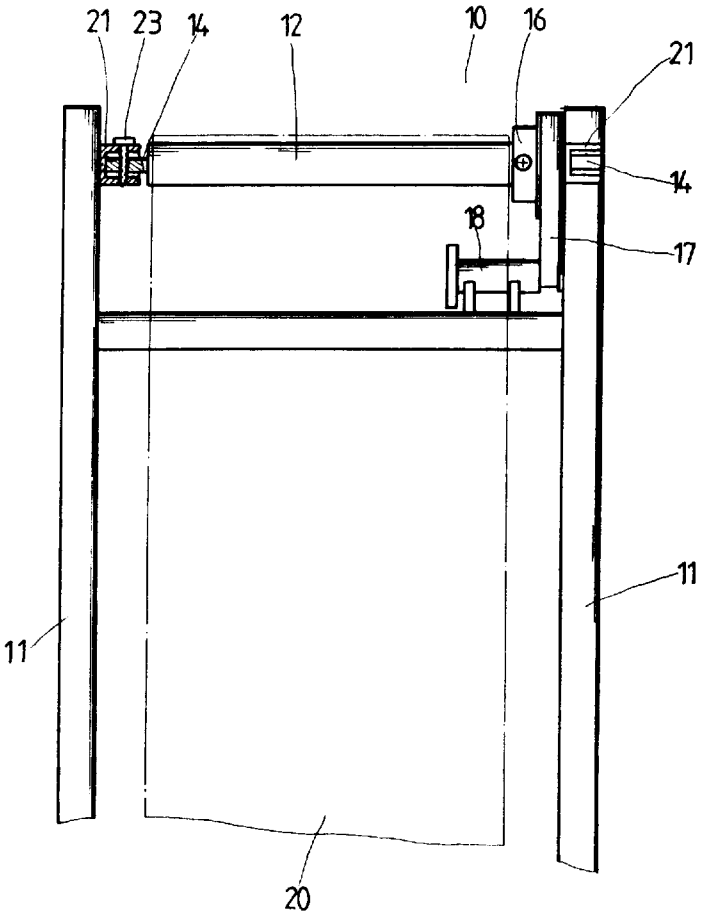
FIG.2 PRIOR ART
FIG. 2 is a partial planar and partially cut-away diagram of the assembling structure of the front pulley of a prior treadmill.
Figure 4:
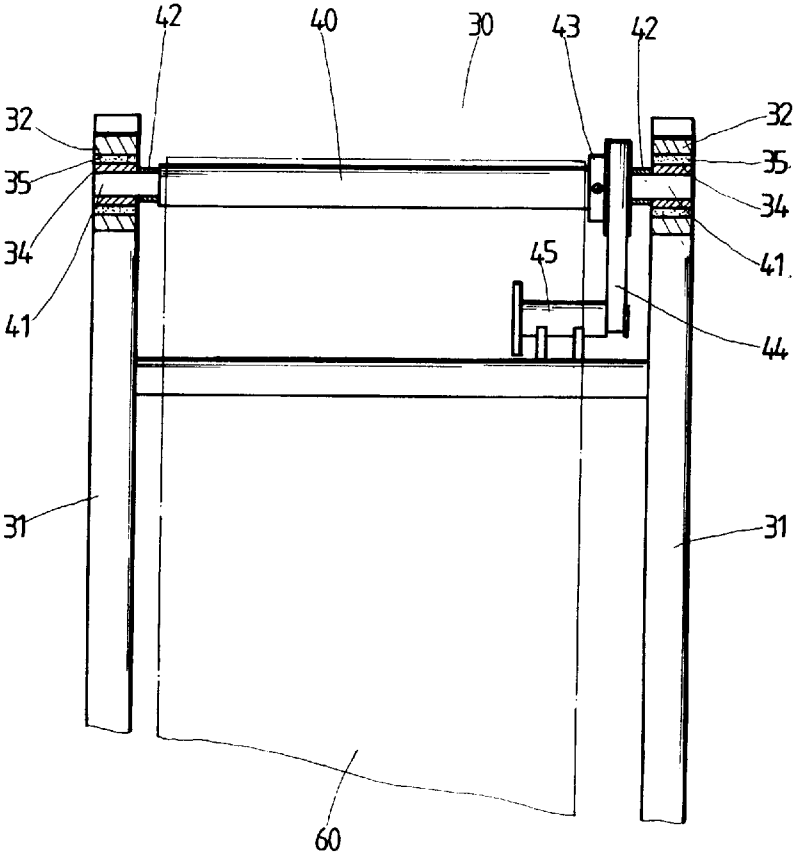
FIG. 4 is a partial planar and partially cut-away diagram of the present invention.
Figure 3:
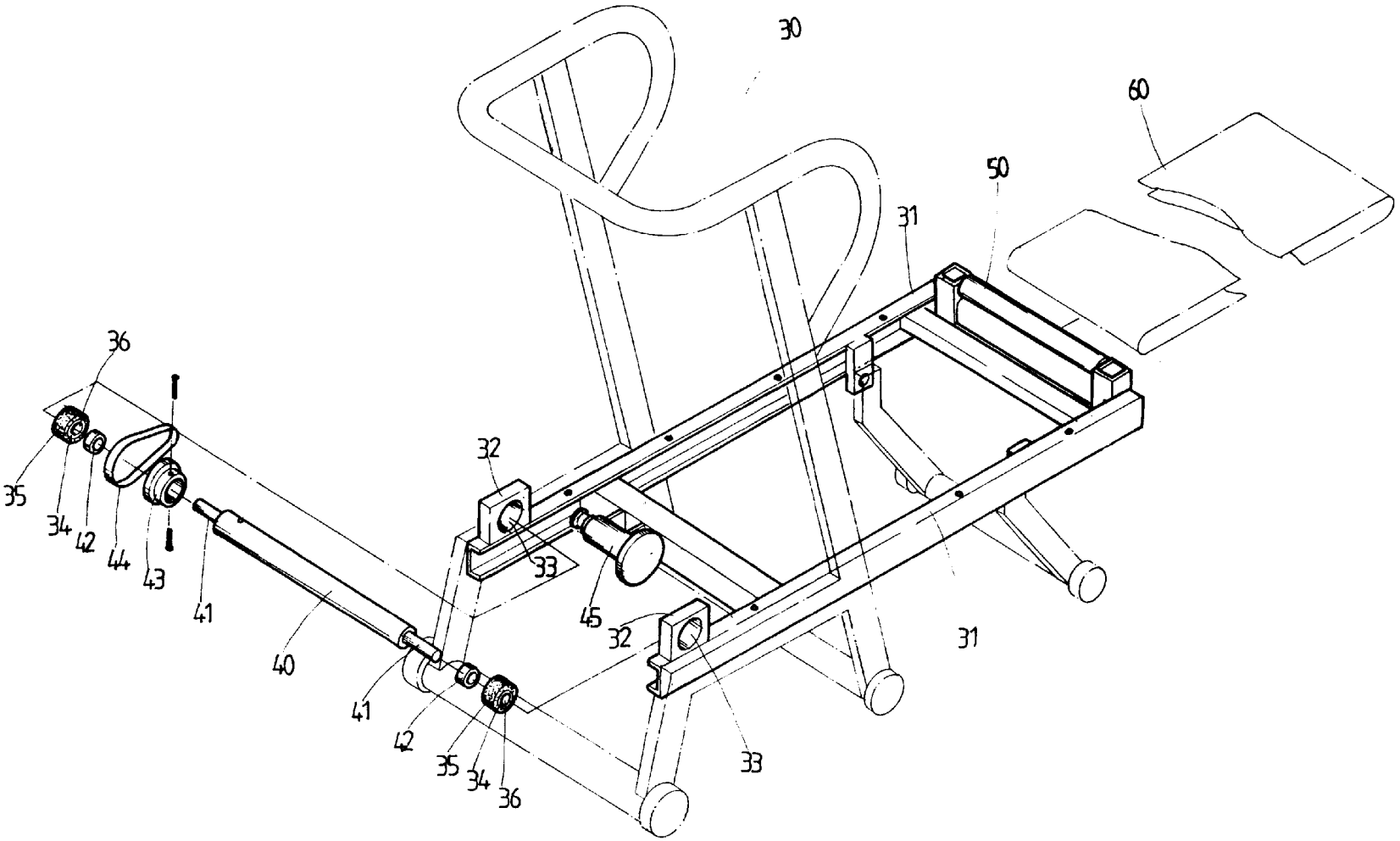
FIG. 3 is an exploded perspective view of the present invention.

First, referring to FIGS. 3 and 4, a positioning plate 32 is disposed at each side of the front end of a frame 31 of a treadmill 30. A hole 33 is located at the middle of the positioning plate 32, and a resilient body 35 having hollow metal ring 34 at its inner is sideways disposed in each hole 33. Shafts 41 at both sides of the front pulley 40 in cooperation with two washers 42 are disposed in the inner holes 36 of the metal rings 34 of the resilient bodies 35. When the rear pulley 50 at both side of the frame 31 is integrated, while the running belt 60 is assembled on the front and rear pulleys 40 and 60 and is tightened, the front pulley 40 keeps on a parallel with the rear pulley 50 automatically because of the tightening effect of the running belt 60 by the action of the two resilient bodies 35. In other words, after the front and rear pulleys 40 and 50 are assembled on the frame 31, if the two pulleys 40 and 50 is not parallel to each other because of the variation of processing, the two resilient bodies 35 at both sides of the shaft 41 of the front pulley 40 are differently compressed because of the pressure, caused by the taut action of the running belt 60, at the left and right sides applied on the two resilient bodies 35 are different. Therefore, those tiny variations are compensated automatically to keep the two pulleys 40 and 50 parallel, thus the running belt 60 continuously circulates around the front and rear pulleys 40 and 50 smoothly.

The flywheel 43 at one side of the front pulley 40, belt 44, and motor 44 are all necessary components, and the detailed description is eliminated.

Additionally, when a downward force is applied on the running, belt 60, the two resilient bodies 35 rebound or are further compressed. In other words, when the pressure applied on the front pulley 40 is larger, the two resilient bodies 35 are in an inward compressing stage. When the pressure becomes smaller, they rebound outward immediately. Thus, the front pulley, 40 and the running belt 60 are always in a closely contacting stage, thereby idling between the front pulley 40 and the running belt 60 does not occur thereby increases the operation safety.

From the above, the invention has never been disclosed by the commercial products and the related publications, and has the practical value of advance and progress, which consists with the requirement of patent application and should be protected under the patent law. Thus the application is filed according to the related law.

I claim:

1. A treadmill having a frame and comprising:

a) a positioning plate mounted adjacent to a first end of each of two opposite sides of the frame;

b) a resilient body mounted on each positioning plate;

c) a first pulley having opposite ends, each opposite end rotatably supported in one of the resilient bodies;

d) a second pulley rotatably mounted adjacent to a second end of the frame oriented substantially parallel to the first pulley, and, e) an endless running belt extending around the first and second pulleys, whereby the resilient bodies enable the first pulley to remain substantially parallel to the second pulley during movement of the endless belt.

2. The treadmill of claim 1 wherein each of the positioning plates has a hole and wherein the associated resilient body is mounted in the hole.

3. The treadmill of claim 1 further comprising:

a) a hollow metal ring mounted in each resilient body; and, b) a shaft extending from each opposite end of the first pulley and located in the hollow metal ring.

* * * * *